US005758381A

United States Patent [19]

Rocha

[11] Patent Number: 5,758,381

[45] Date of Patent: Jun. 2, 1998

[54] FOOT SCRUBBING APPARATUS

[76] Inventor: Manuel Rocha, 22 Cottage St., Newark, N.J. 07102

[21] Appl. No.: 828,046

[22] Filed: Mar. 28, 1997

[51] Int. Cl.[6] ..... A47K 7/02

[52] U.S. Cl. ..... 15/160; 15/104.92; 15/106; 15/114; 4/606; 601/136; D4/130

[58] Field of Search ..... 15/106, 114, 104.92, 15/160, 161; 4/606; 601/136; D4/119, 130

[56] References Cited

U.S. PATENT DOCUMENTS

| | | | |
|---|---|---|---|
| 2,591,331 | 4/1952 | Baumbach | 15/160 |
| 2,852,793 | 9/1958 | Shelton | 15/104.92 |
| 3,531,814 | 10/1970 | Safalow | 15/114 |
| 4,520,525 | 6/1985 | Yogi et al. | 15/104.92 |
| 4,943,018 | 7/1990 | Glaser et al. | 4/606 X |
| 5,177,829 | 1/1993 | Simpson | 15/161 X |
| 5,473,788 | 12/1995 | Agagona | 15/104.92 |

FOREIGN PATENT DOCUMENTS

| | | | |
|---|---|---|---|
| 375459 | 6/1990 | European Pat. Off. | 4/606 |

*Primary Examiner*—Mark Spisich

[57] ABSTRACT

A new Foot Scrubbing Apparatus for cleaning and scrubbing feet and hands. The inventive device includes a base member having an upper contoured surface, a plurality of bristles secured to the upper surface, a between digit scrubbing member removably secured to the upper surface, and suction cups on the bottom of the base member for securing the base member to a support surface.

11 Claims, 5 Drawing Sheets

FOOT SCRUBBING APPARATUS

BACKGROUND OF THE INVENTION

1. Field of the Invention

The present invention relates to foot scrubbing and cleaning devices and more particularly pertains to a new Foot Scrubbing Apparatus for cleaning and scrubbing feet and hands.

2. Description of the Prior Art

The use of foot scrubbing and cleaning devices is known in the prior art. More specifically, foot scrubbing and cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art foot scrubbing and cleaning devices include U.S. Pat. Nos. 4,617,917; 3,973,286; 5,321,867; 5,163,200; U.S. Pat. Des. 283,850 and U.S. Pat. No. 4,520,525.

While these devices fulfill their respective, particular objectives and requirements, the aforementioned patents do not disclose a new Foot Scrubbing Apparatus. The inventive device includes a base member having an upper contoured surface, a plurality of bristles secured to the upper surface, a between digit scrubbing member removably secured to the upper surface, and suction cups on the bottom of the base member for securing the base member to a support surface.

In these respects, the Foot Scrubbing Apparatus according to the present invention substantially departs from the conventional concepts and designs of the prior art, and in so doing provides an apparatus primarily developed for the purpose of cleaning and scrubbing feet and hands.

SUMMARY OF THE INVENTION

In view of the foregoing disadvantages inherent in the known types of foot scrubbing and cleaning devices now present in the prior art, the present invention provides a new Foot Scrubbing Apparatus construction wherein the same can be utilized for cleaning and scrubbing feet and hands.

The general purpose of the present invention, which will be described subsequently in greater detail, is to provide a new Foot Scrubbing Apparatus apparatus and method which has many of the advantages of the foot scrubbing and cleaning devices mentioned heretofore and many novel features that result in a new Foot Scrubbing Apparatus which is not anticipated, rendered obvious, suggested, or even implied by any of the prior art foot scrubbing and cleaning devices, either alone or in any combination thereof.

To attain this, the present invention generally comprises a base member having an upper contoured surface, a plurality of bristles secured to the upper surface, a between digit scrubbing member removably secured to the upper surface, and suction cups on the bottom of the base member for securing the base member to a support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Foot Scrubbing Apparatus apparatus and method which has many of the advantages of the foot scrubbing and cleaning devices mentioned heretofore and many novel features that result in a new Foot Scrubbing Apparatus which is not anticipated, rendered obvious, suggested, or even implied by any of the prior art foot scrubbing and cleaning devices, either alone or in any combination thereof.

It is another object of the present invention to provide a new Foot Scrubbing Apparatus which may be easily and efficiently manufactured and marketed.

It is a further object of the present invention to provide a new Foot Scrubbing Apparatus which is of a durable and reliable construction.

An even further object of the present invention is to provide a new Foot Scrubbing Apparatus which is susceptible of a low cost of manufacture with regard to both materials and labor, and which accordingly is then susceptible of low prices of sale to the consuming public, thereby making such Foot Scrubbing Apparatus economically available to the buying public.

Still yet another object of the present invention is to provide a new Foot Scrubbing Apparatus which provides in the apparatuses and methods of the prior art some of the advantages thereof, while simultaneously overcoming some of the disadvantages normally associated therewith.

Still another object of the present invention is to provide a new Foot Scrubbing Apparatus for cleaning and scrubbing feet and hands.

Yet another object of the present invention is to provide a new Foot Scrubbing Apparatus which includes a base member having an upper contoured surface, a plurality of bristles secured to the upper surface, a between digit scrubbing member removably secured to the upper surface, and suction cups on the bottom of the base member for securing the base member to a support surface.

Still yet another object of the present invention is to provide a new Foot Scrubbing Apparatus that eliminates the use of hand held cleaning and scrubbing devices.

Even still another object of the present invention is to provide a new Foot Scrubbing Apparatus that improves between digit cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
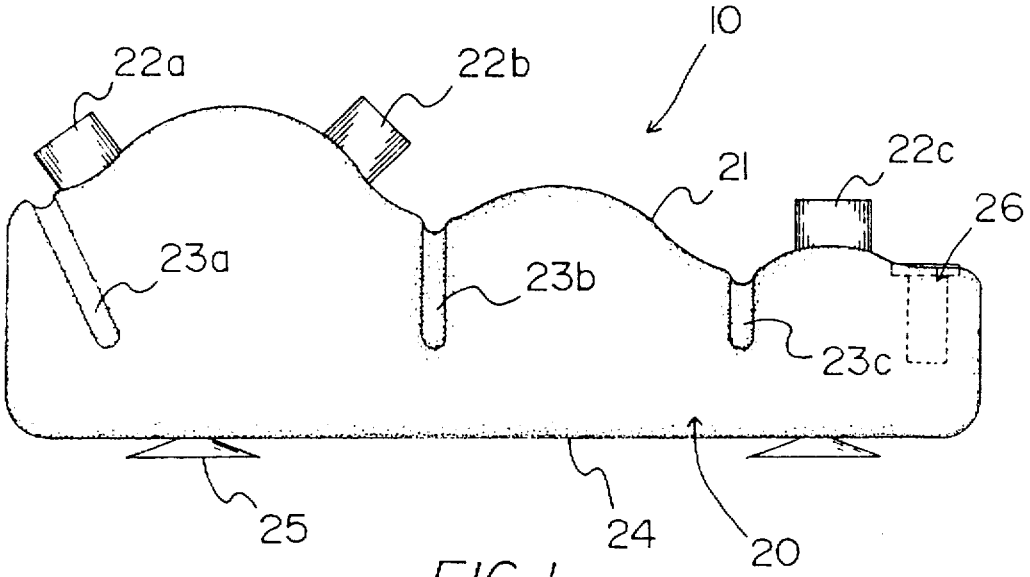
FIG. 1 is a side view of a new Foot Scrubbing Apparatus according to the present invention.
Figure 2:
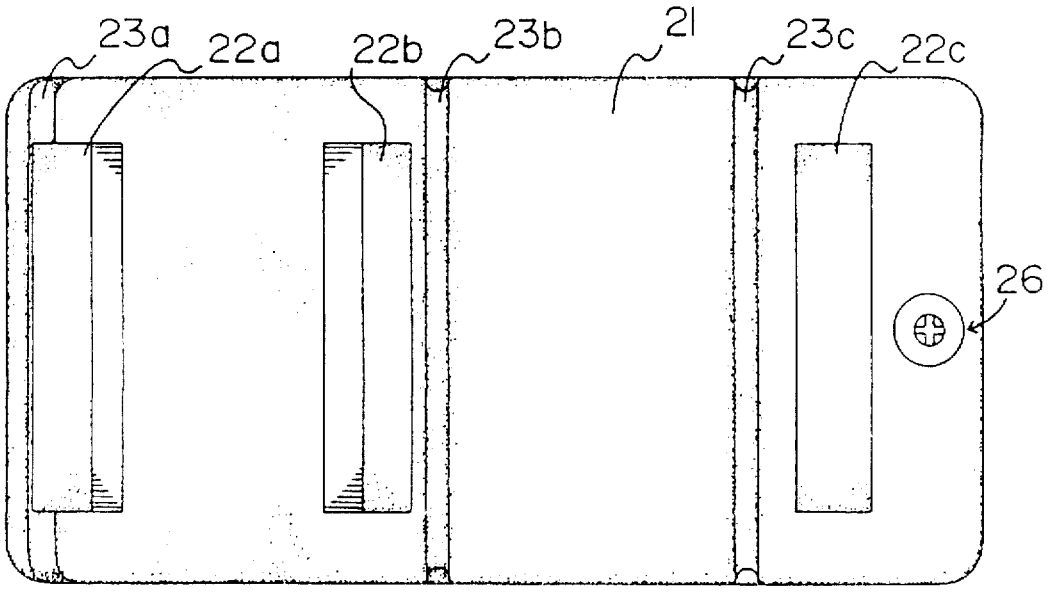
FIG. 2 is a top view thereof.
Figure 3:
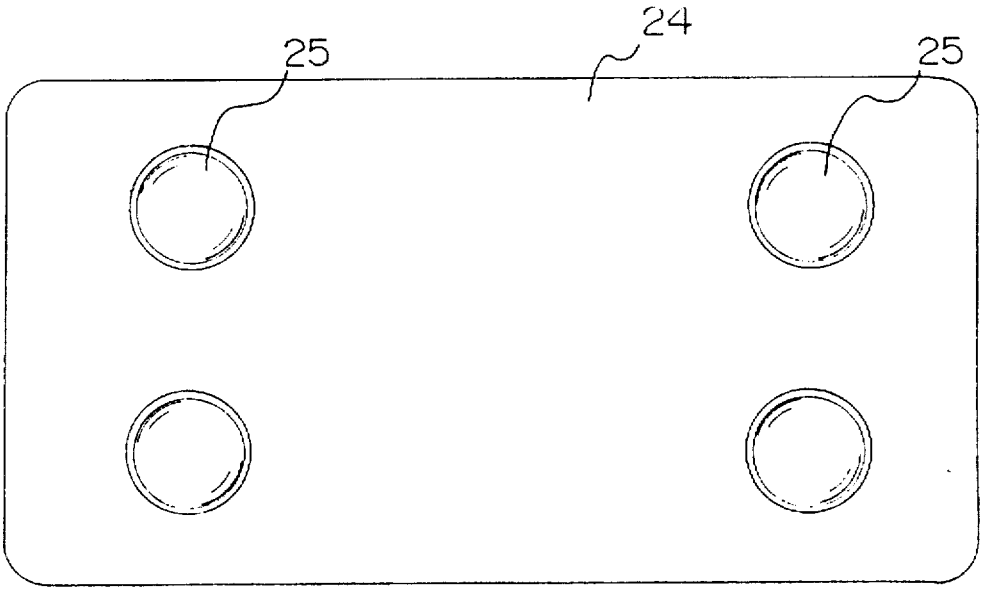
FIG. 3 is a bottom view thereof.
Figure 4:
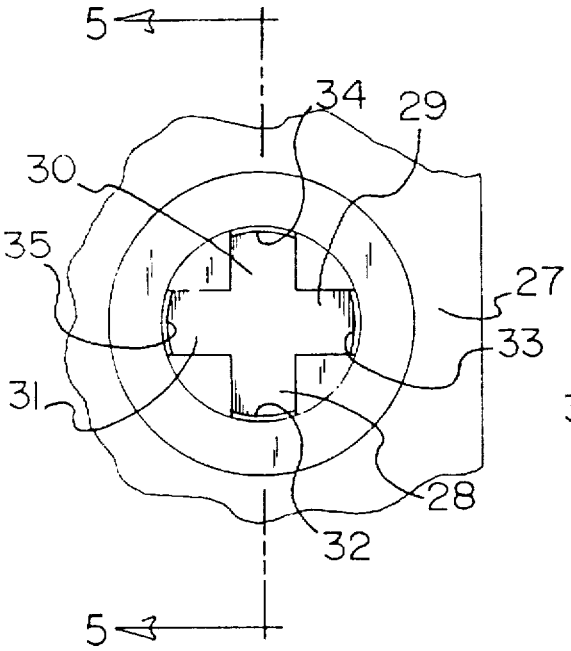
FIG. 4 is a view of a portion of the upper surface showing a recess for attaching a scrubbing member.
Figure 5:
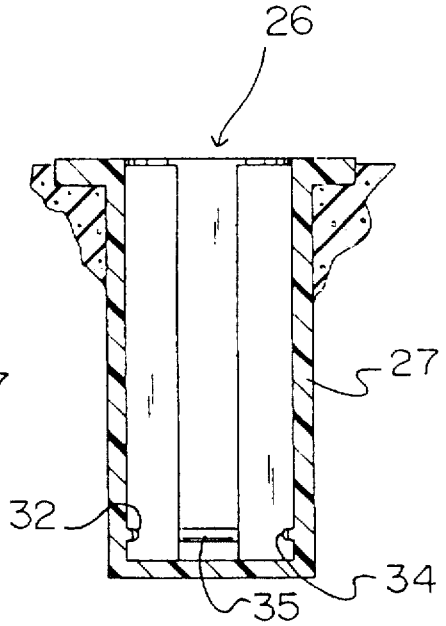
FIG. 5 is a cross sectional view taken along line 5—5 of FIG. 4.
Figure 6:
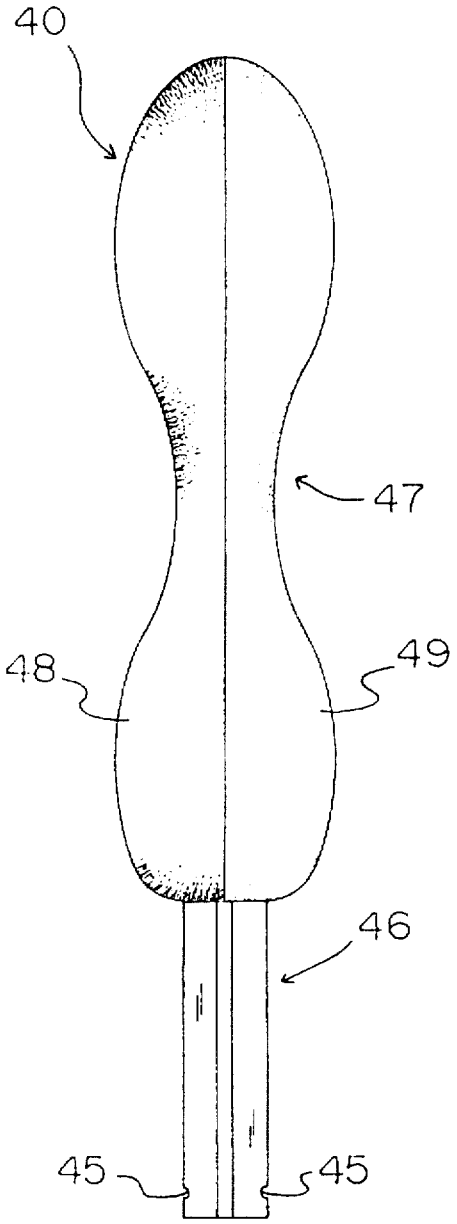
FIG. 6 is a view of one embodiment of the scrubbing member.
Figure 7:
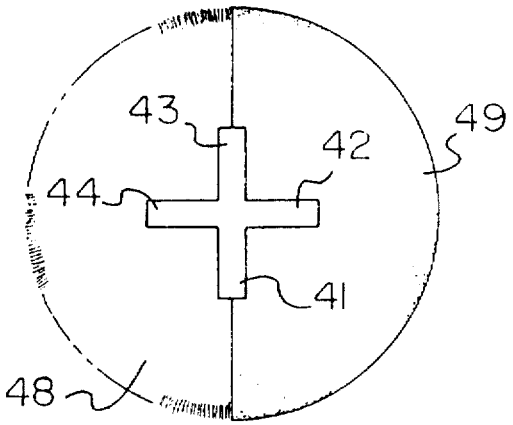
FIG. 7 is a bottom view of the scrubbing member of FIG. 6.
Figure 8:
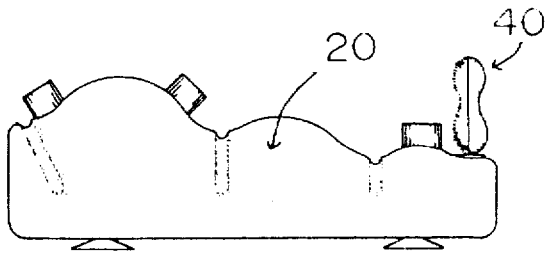
FIG. 8 is a view of the scrubbing member attached to the base member.

With reference now to the drawings, and in particular to FIGS. 1 through 12 thereof, a new Foot Scrubbing Apparatus embodying the principles and concepts of the present invention and generally designated by the reference numeral 10 will be described.

More specifically, it will be noted that the Foot Scrubbing Apparatus 10 comprises a base member 20 and a scrubbing member 40 removably attached to the base member.

As best illustrated in FIGS. 1 through 12, it can be shown that the base member 20 has an upper surface 21 which is contoured so as to mimic the contours of the bottom of a persons foot. Most feet are not flat, but include arches, ridges, and curved surfaces. The contoured surface 21 thus is able to follow the contour of a foot and provide more effective cleaning and scrubbing. The base member 20 is formed of a material which is soft and soothing to feet, and able to operate in a wet environment, such as sponge rubber or the like.

Secured to the upper surface 21 are bunches of bristles 22*a*–*c*. The bunches are elongated so as to cover most of the width of the upper surface. The bristles provide a scrubbing action on portions of the feet, so the bristles should be sufficiently stiff to provide such scrubbing action. The bunches are placed at various locations on the upper surface to scrub different portions of the feet. For instance, bunch 22*b* can scrub the heel of the foot while bunch 22*c* scrubs the bottom of the toes.

Channels 23*a*–*c* are formed within the upper surface at various locations in order to channel soap and water from the upper surface. This prevents the foot from slipping on the upper surface.

The base member 20 also includes a planar bottom surface 24 for resting on a support surface. The bottom surface includes securement means, such as suction cups 25, for preventing the base member from sliding on the support surface. The suction cups also permit the base member to be secured to an angled or vertical support surface.

Disposed through the top surface of the base member is a recess 26 for attaching a scrubbing member to be later described. The recess 26 includes a plastic liner 27 fit within the base member for providing a rigid wall for the recess. The liner 27 includes four slots 28–31 meeting at the center to define an aperture in the form of a cross. The base of each slot includes a rounded protrusion 32-35, the purpose of which will become apparent later. The liner is secured to the base member in any appropriate fashion, such as with adhesives.

Attached to the base member such that it extends from the upper surface is a between digit scrubbing member 40. The scrubbing member includes a support post 46 having four arms 41–44 in the shape of a cross to fit within the liner aperture so as to secure the member 40 to the base member 20. The base of each arm includes a detent 45 for mating with the projections 32–35. The member 40 is attached by inserting the post 46 into the aperture until the detents 45 mate with the projections 32–35. Removal is accomplished by simply pulling the scrubbing member with sufficient force to overcome the detent and projection locking force.

Figure 11:
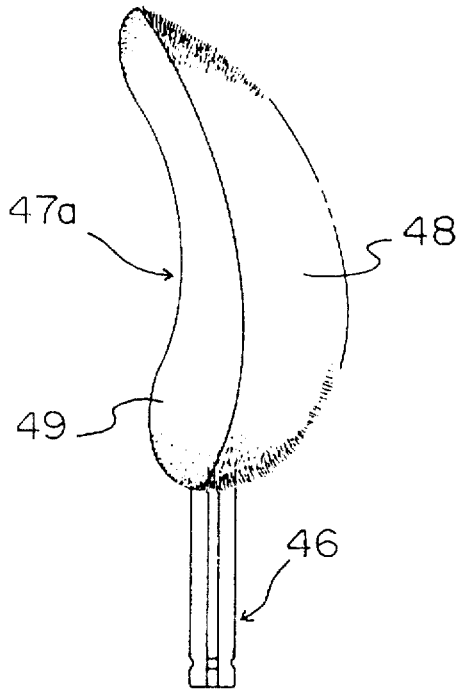
FIG. 11 is a view of a second embodiment of the scrubbing member.

The member 40 includes a scrubbing portion 47,47*a* which is intended to fit between toes, or fingers, to clean and scrub between them. The portion 47,47*a* is contoured, thus giving the portion a barbell shape (FIG. 6) or a banana shape (FIG. 11). Contouring allows the portion 47,47*a* to be inserted between all of the toes. The portion 47,47*a* includes different scrubbing surfaces 48,49, each having a different roughness. For instance, surface 48 can be relatively flexible with a low roughness, while surface 49 is stiff with a high roughness. Having different roughness permits differing scrubbing effects on the toes. Each surface comprises about one-half of the portion 47,47*a*.

Figure 9:
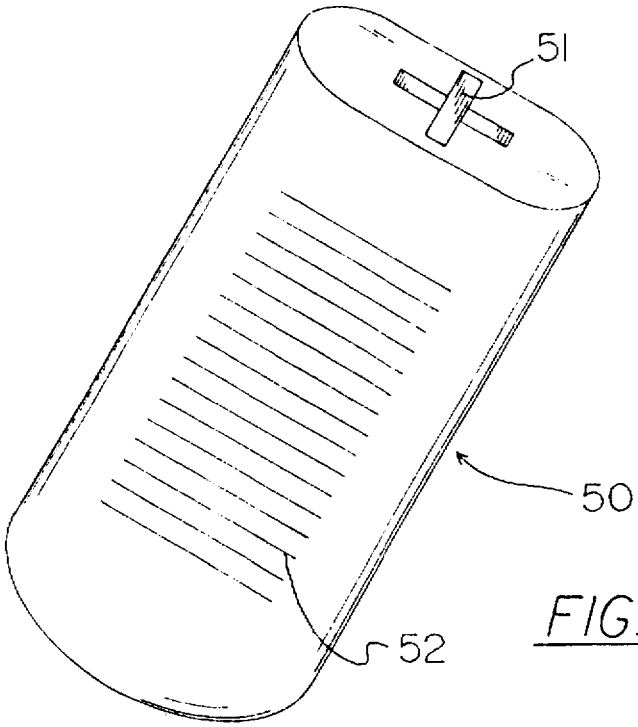
FIG. 9 is a view of a hand held device for holding a scrubbing member.

FIG. 9 illustrates a handle 50 which can be used with the member 40. The handle includes a recess 51 for receiving the support post 46 and gripping aids 52 for aiding in holding the handle. The support post is secured in a similar manner as in FIGS. 1–8. The handle 50 permits a user to scrub between the toes by hand.

Figure 10:
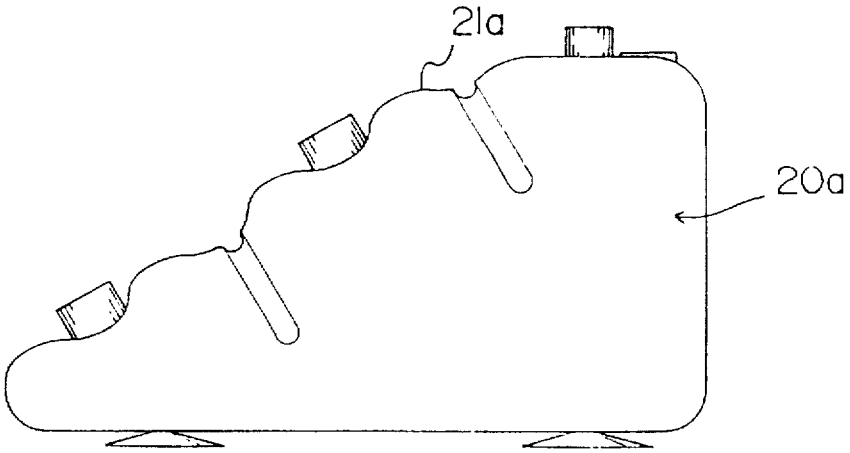
FIG. 10 is an alternate embodiment showing a different contoured upper surface.

FIG. 10 illustrates an alternate embodiment of a base member 20*a* having a differently contoured upper surface 21*a*. This embodiment is otherwise similar to the base member 20 shown in FIG. 1.

Figure 12:
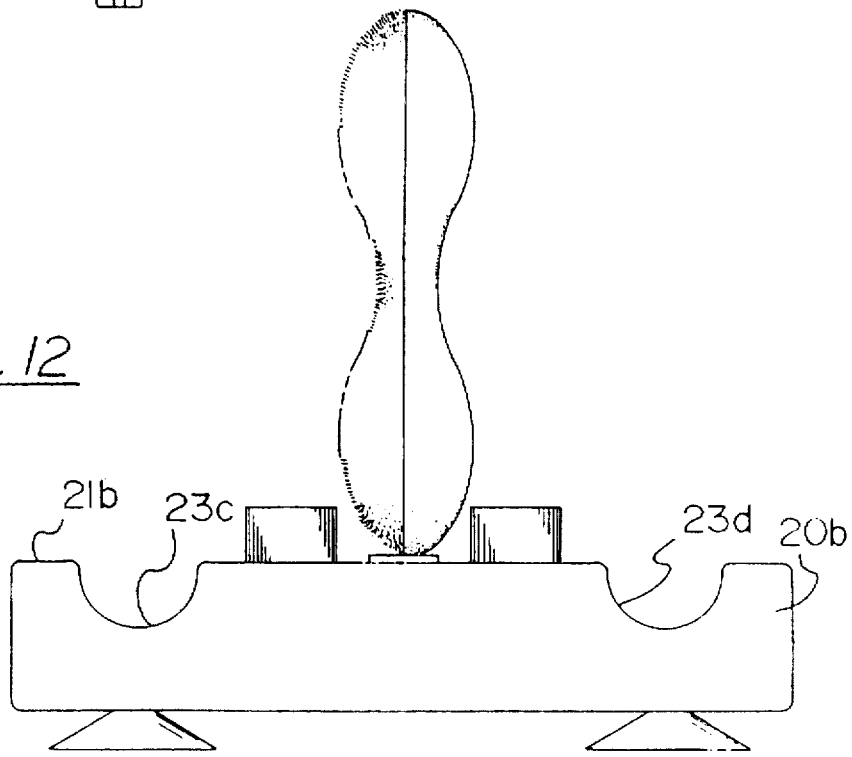
FIG. 12 is another alternate embodiment showing a different contoured upper surface.

FIG. 12 illustrates a further embodiment of a base member 20*b* having a contoured upper surface 21*b*. The upper surface in this embodiment includes enlarged channels 23*d*, 23*e* which can retain soap. By dipping toes or fingers into the channels, they are coated with soap for added cleaning.

In use, the base member is placed on a supporting surface, such as the bottom of a bathtub or shower. The suction cups keep the base member firmly in place. A person them moves his foot back and forth over the bristle bunches, in order to scrub various portions of his foot. The scrubbing member can be attached to the base member, and the user then alternately scrubs between his toes by fitting the scrubbing member in the gaps between his toes. It is of course apparent that this device could be used to clean a persons hands and fingers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot scrubbing apparatus comprising:

a base member having an upper contoured surface and a bottom surface:

a plurality of bristles secured to the upper contoured surface;

securement means attached to the bottom surface for securing the base member on a support surface; and a plurality of channels on the upper surface for channeling water and soap from the upper surface.

2. The foot scrubbing apparatus of claim 1, wherein the base member is comprised of sponge rubber.

3. The foot scrubbing apparatus of claim 1, further comprising a between digit scrubbing member removably attached to the upper surface.

4. The foot scrubbing apparatus of claim 3 wherein the scrubbing member includes a support post, and the base member includes a recess receiving the support post.

5. The foot scrubbing apparatus of claim 3, wherein the scrubbing member includes a contoured surface.

6. The foot scrubbing apparatus of claim 3, wherein the scrubbing member is barbell shaped.

7. The foot scrubbing apparatus of claim 3, wherein the scrubbing member is banana shaped.

8. The foot scrubbing apparatus of claim 3, wherein the scrubbing member includes a plurality of scrubbing surfaces, each surface having a different scrubbing roughness.

9. The foot scrubbing apparatus of claim 8, wherein one of said scrubbing surfaces comprises about one-half of the scrubbing member, and another of said scrubbing surfaces comprises about the other one-half of the scrubbing member.

10. The foot scrubbing apparatus of claim 1, wherein the securement means comprises suction cups.

11. A foot scrubbing apparatus comprising:

a sponge rubber base member having an upper contoured surface and a bottom surface, said upper surface including a plurality of channels for channeling water and soap from the upper surface, and a between digit scrubbing member with a contoured surface removably attached to the upper surface;

the scrubbing member including a support post, and the base member including a recess receiving the support post;

the scrubbing member further including a plurality of scrubbing surfaces, each surface having a different scrubbing roughness, one of said scrubbing surfaces comprises about one-half of the scrubbing member, and another of said scrubbing surfaces comprises about the other one-half of the scrubbing member;

a plurality of bristles secured to the upper contoured surface; and suction cups attached to the bottom surface for securing the base member on a support surface.

* * * * *